United States Patent [19]

Kovář et al.

[11] 4,186,583

[45] Feb. 5, 1980

[54] APPARATUS FOR CROSS WEDGE ROLLING

[75] Inventors: Jan Kovář, Ricmanice; Jan Drkal, Brno; Jan Zálešák, Modrice; Vaclav Hladký, Brno, all of Czechoslovakia

[73] Assignee: Vyzkumny ustav tvarecich stroju a technologie tvareni, Brno, Czechoslovakia

[21] Appl. No.: 903,522

[22] Filed: May 8, 1978

[51] Int. Cl.[2] ..... B21H 1/00

[52] U.S. Cl. ..... 72/108; 72/109

[58] Field of Search ..... 72/108, 109, 465; 29/126

[56] References Cited

U.S. PATENT DOCUMENTS

| | | | |
|---|---|---|---|
| 352,365 | 11/1886 | Simonds | 72/469 |
| 2,953,291 | 9/1960 | Huck | 29/126 |
| 3,552,167 | 1/1971 | Bergi et al. | 29/159.2 |
| 4,020,665 | 5/1977 | Koizumi et al. | 72/108 |

*Primary Examiner*—Lowell A. Larson

[57] ABSTRACT

In order properly to guide a workpiece in the course of cross wedge rolling, there are provided adjustable guide means within the working space of the rolling mill, and means for transmitting a rotary motion to the workpiece prior to the start of the rolling process proper.

2 Claims, 4 Drawing Figures

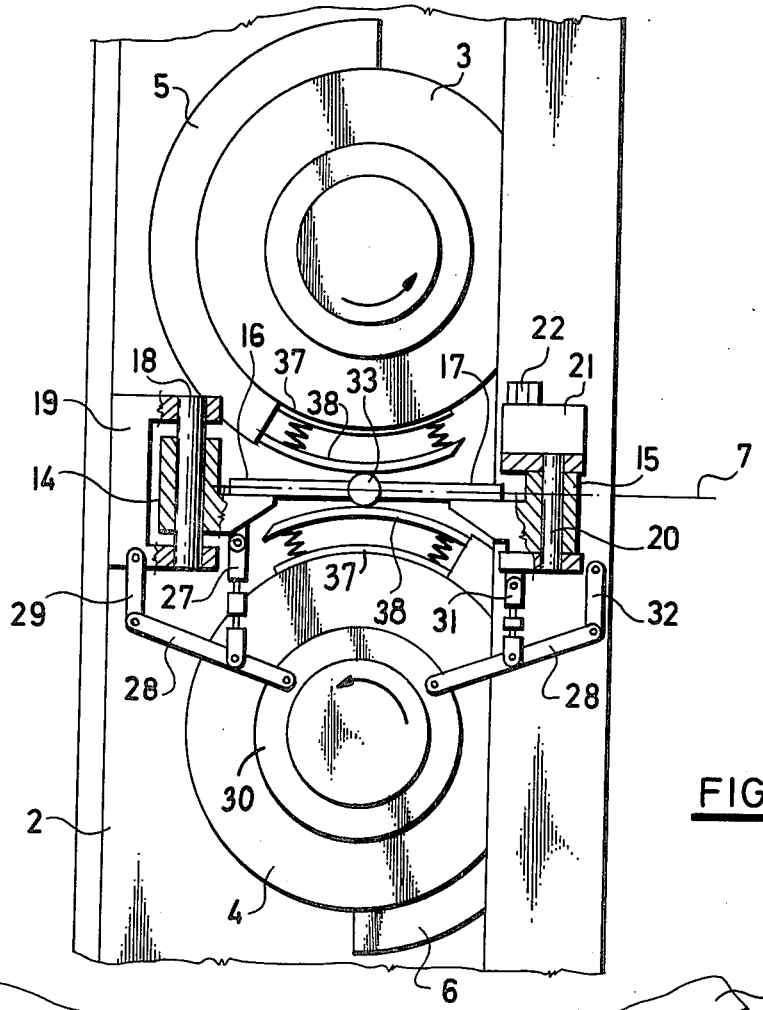
FIG. 2
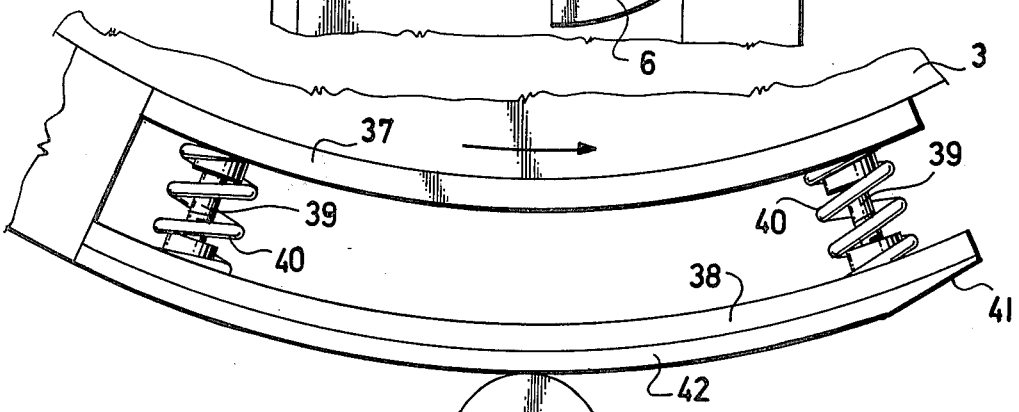
FIG. 4
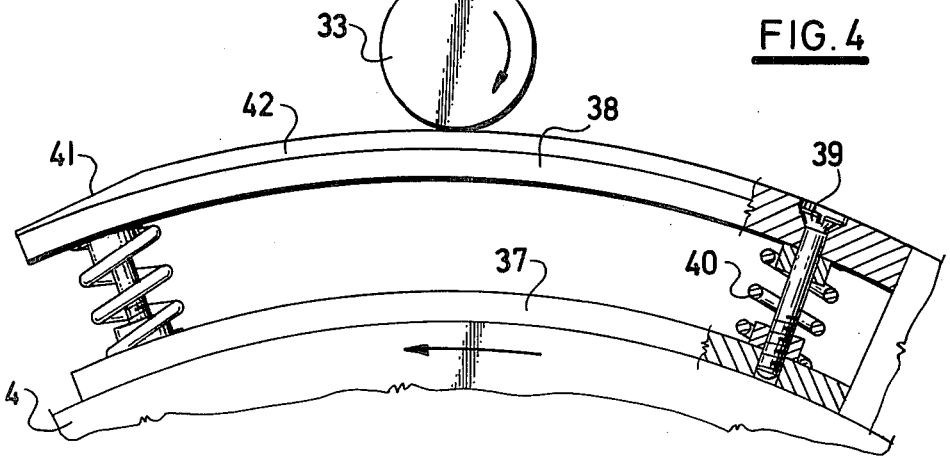

APPARATUS FOR CROSS WEDGE ROLLING

BACKGROUND OF THE INVENTION

The invention relates to an apparatus for cross wedge rolling, such apparatus being provided with two parallel rolls, the distance between the axes of which is adjustable by adjustment of at least one of said rolls. A workpiece or rod is rolled between the rolls by wedge-shaped tools on the rolls; this invention particularly relates to the arrangement of auxiliary elements in the rolling space between the rolls.

By the expression "cross wedge rolling" as used herein, there is meant a rolling process wherein a workpiece is rolled between opposed rolls, with the axis of the workpiece extending generally parallel to the axes of the rolls.

Known arrangements for cross wedge rolling do not have auxiliary elements which guide the workpiece into and in the working space, nor which transmit to the workpiece a rotary motion prior to the time when the workpiece is engaged by the rolling tools proper.

The consequence of this is a movement of the workpiece which is not exact, and a slipping between the workpiece and the rolls at the beginning of the rolling operation, particularly if the workpieces are heavy.

SUMMARY OF THE INVENTION

It is an object of this invention to eliminate these drawbacks and to provide auxiliary elements for cross wedge rolling which properly guide the workpiece and transmit to it a rotary motion prior to rolling. In accordance with this invention, guide bars for the workpiece are provided in the working space between the working rolls, as well as a unit on at least one of the rolls for guiding and starting the rotating motion of the workpiece. Preferably a pair of the units for starting the rotating motion are used and are sprung.

Another feature of the invention is that each unit for starting the rotating motion comprises a clamping segment and a segment taken along therewith adapted for relative rolling, said segments being connected by screws and spacing springs.

In the disclosed embodiment, the guide bars are fixed on yokes, one of which yokes with one guide bar being arranged vertically slidable on bolts fixed by means of a bracket to the side member of the frame of the apparatus, whereas the second yoke with the second guide bar has one end supported pivotably on a bolt anchored in a support and is detachably connected at its other end preferably by a screw and nut to another support, whereby each of said supports is arranged slidably on a bar of dovetail cross-section fixed to the frame. The yokes are connected swingably by longitudinally adjustable tie rods to one-arm levers, one end of which is pivotably connected to side members of the frame, the other end of which is connected to an adjustable bearing for one of the working rolls.

DESCRIPTION OF THE DRAWINGS

An exemplary embodiment of the apparatus of this invention is shown in the attached drawings, wherein:

FIG. 2 is a diagrammatic side view partially in section of the apparatus of FIG. 1;

FIG. 4 is a fragmentary side view of a cooperating pair of units for starting the rotating motion of a workpiece.

DESCRIPTION OF PREFERRED EMBODIMENT

Figure 1:
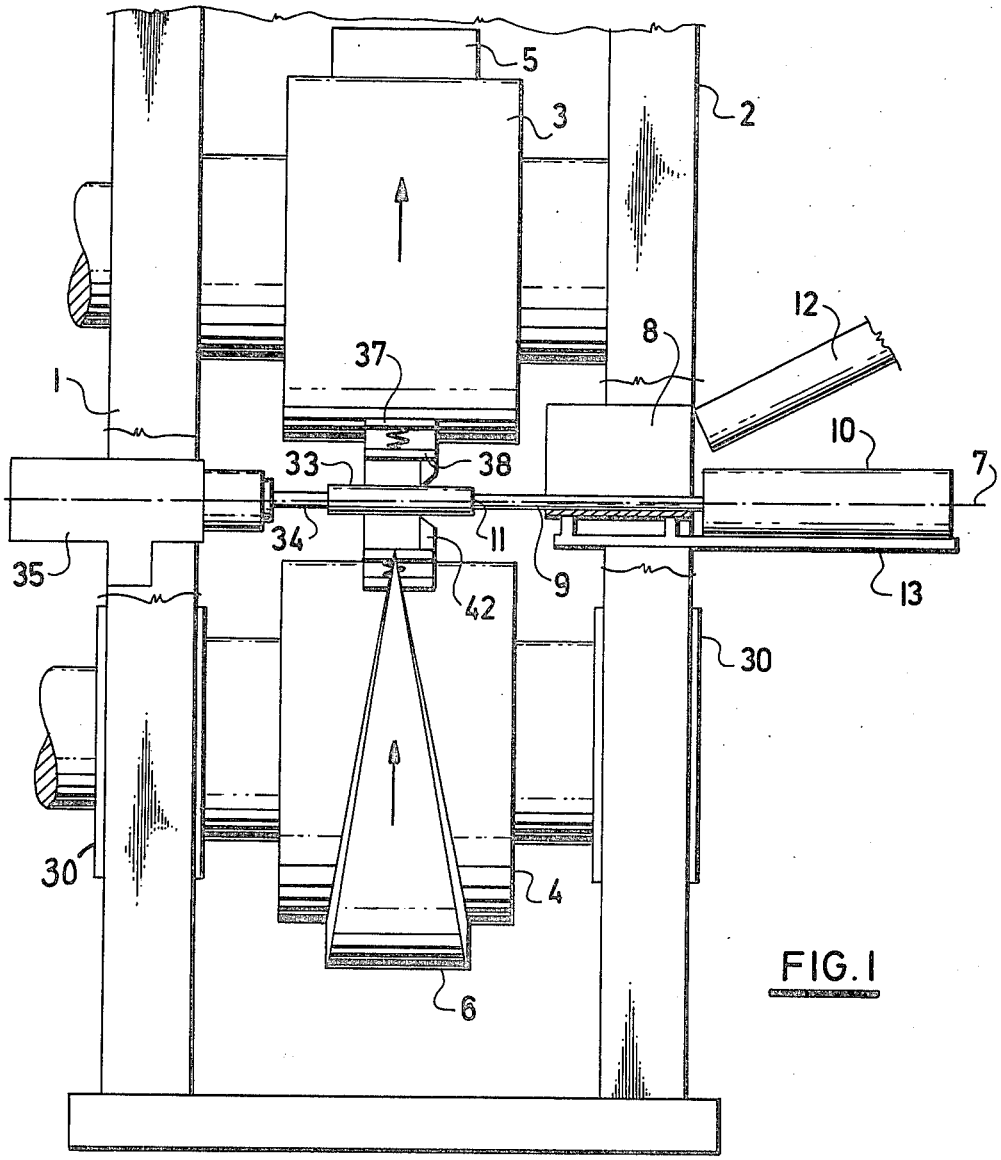
FIG. 1 is a diagrammatic elevation of the apparatus with a section through the workpiece feeding device.

Two working rolls 3 and 4 are supported by the side walls 1 and 2 of the frame of a roll stand, there being wedge rolling tools 5 and 6 affixed to said working rolls 3 and 4. The upper working roll 3 is supported rotatably at a fixed height by bearings (not shown), whereas the second, lower working roll 4 is rotatably supported in adjustable bearings 30 which can be vertically adjusted in the frame side members 1 and 2.

A workpiece feeding device is situated in one side member 2 in the rolling axis, said feeding device comprising a trough 8, wherein a piston rod 9 of a pneumatic cylinder 10 is freely slidable along the rolling axis 7. The piston rod 9 is provided on its free end with an adaptable stop 11. A channel chute 12 is situated above the pneumatic cylinder 10. The trough 8 and the pneumatic cylinder 10 are fixed to a supporting plate 13, which is advantageously fixed to yokes 14 and 15 (FIG. 2) of the guiding device.

Figure 3:
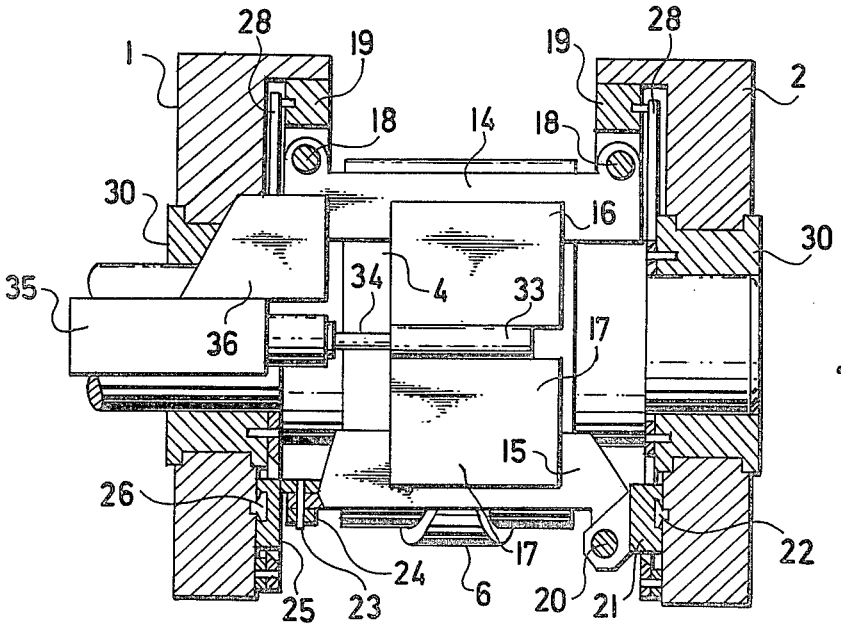
FIG. 3 is a view in horizontal section including a top view of the guiding means.

The guiding device comprises a pair of guide bars 16 and 17 engaging symmetrically into the working space between rolls 3, 4 from both sides and fixed on yokes 14 and 15. One of the yokes 14 is vertically slidably supported on a pair of bolts 18 anchored in brackets 19 which are connected to the side members 1 and 2 of the frame. The second yoke 15 is pivotably supported at one end on a bolt 20 having both ends anchored in a suppport 21 vertically slidably supported on a bar of dovetail cross-section secured to the side member 2. The opposite end of the yoke 15 is detachably connected, for instance, by means of a screw 23 with a nut 24 (FIG. 3) to another support 25 supported vertically slidably on another bar 26 of dovetail cross-section fixed to the other side member 1.

The vertical shifting of the guide bars 16 and 17 (FIG.2) is effected by a pair longitudinally adjustable tie rods 27 connected between one yoke 14 and the guide bar 16, each of such tie rods being connected at its other end to the central part of one of the one-arm levers 28. One end of each one-arm levers 28 is pivotally connected by way of a swinging tie rod 29 to a bracket 19, whereas the opposite end is pivotally connected to a respective adjustable bearing 30 for the lower working roll 4 (FIG. 1).

Another pair of longitudinally adjustable tie rods 31 serves for the vertical adjustment of the second guide bar 17 (FIG. 2); one end of said tie rods 31 is connected at one end to the supports 21 and 25 (FIG. 3) whereby the pair of swingable tie rods 32 (FIG. 2) is connected to the side members 1 and 2.

The lengths of the levers are so chosen that in case of adjustment of the position of the lower working roll 4 which is supported in adjustable bearings 30 the guide bars 16 and 17 are shifted through a distance which is half the vertical movement of the working roll 4, so that the guide bars 16 and 17 remain constantly in the plane of the rolling axis 7.

The workpiece 33 which rests with one end against the adjustable rod 34 of the stop device (FIG. 3) is placed between the guide bars 16 and 17. A stop device 35 is fixed to the supporting plate 36, which is connected to the yoke 14.

A unit for starting the rotating motion of the workpiece is situated on each of the working rolls 3 and 4 in front of the rolling tools 5 and 6 thereon. Said unit comprises a first, radially inner attacking segment 37 (FIG. 4) adapted to be fixed on the working rolls 3, 4, for instance, by screws (not shown), and a second, radially outer workpiece engaged by a segment 38 which rotates therewith. The segment 38 is connected for resiliently opposed radially inward movement with respect to the segment 37 by at least one pair of screws 39 passing through spacing springs 40 arranged between both segments 37 and 38. One end of the segment 38 distant from the rolling tools 5, 6 is provided with a starting bevel 41. The lateral wall of each of the segments 38 facing the trough 8 of the feeding device is provided with a lateral beveled surface 42 for the easy introduction of the workpiece 33 between the pair of segments 38.

It is possible to provide more units for starting the rotating motion with segments 38 both directly one behind the other in order to maintain the workpiece 33 in rotation for a longer track or intermittently, their location on the working rolls 3 and 4 being determined by the technological requirements for securing the rotation of the workpiece 33 in the course of certain parts of the rolling process, or in the course of its separation from a rod (not shown) in the case of rolling from a rod.

The apparatus according to this invention operates as follows:

A workpiece 33 is automatically supplied by way of the channel chute 12 of the feeding device from a heating device (not shown) into the trough 8, where it remains until the working rolls 3 and 4 have turned their units for starting the rotating motion to the working space between the rolls. At this moment the pneumatic cylinder 10, due to an impulse from a program device (not shown) shifts the workpiece 33 by means of its piston rod 9 from the trough 8 into the working space between the segments 38. The workpiece 33 strikes the adjustable rod 34 of the stop means 35, which has been previously adjusted to the position required for rolling the workpiece 33. When striking the adjustable rod 34, a feeler (not shown) releases an impulse for the interruption of any further supply of pressure air into the pneumatic cylinder 10 and for the return of the piston rod 9 into its starting position. In the course of the turning of the working rolls 3 and 4, the workpiece 33, due to the action of the segments 38, starts to turn prior to its coming into contact with the rolling tools 5 and 6.

In the course of the introduction of the workpiece 33 into the working space between the rolls 3, 4, the workpiece 33 is introduced not only between the segments 38, but also simultaneously between the pair of guide bars 16 and 17, extending into the working space in horizontal plane, the function of the guide bars being to retain the introduced position of the workpiece 33 during the course of the whole rolling process.

In case of a change of the diameter of the rolled workpiece 33, it is necessary also to change the distance between the working rolls 3 and 4. This is accomplished by any one of a number of commonly known devices, for instance, by a worm gear controlling the position of the adjustable bearings 30 of the working roll 4. In the case of a change of the position of the working roll 4, the height of the guide bars 17 and 16 is simultaneously adjusted so that they remain constantly in the plane of the rolling axis 7. The adjustment of the height of the guide bars 16 and 17 is accomplished by one-arm levers 28 which are operated from the vertically adjustable bearings 30, one-half of the change of height of the bearings 30 being transmitted by the longitudinally adjustable rods 27 to the yoke 14 with the guide bar 16, and by longitudinally adjustable rods 31 to the other yoke 15 with the guide bar 17. One yoke 14 is thereby shifted on the bolt 18, whereas the other yoke 15 together with the support 21 is shifted along the dovetail bar 22.

In cases of adjustment, control of adjustment, and setting of the rools 5, 6, the nut 24 on the screw 23 is loosened, and the yoke 15 with the guide bar 17 is turned around the bolt 20, thus making the working space between the rolls readily accessible.

The arrangement according to this invention can be used for cross wedge rolling of workpieces of different lengths and different diameters.

Although the invention is illustrated and described with reference to a plurality of preferred embodiments thereof, it is to be expressly understood that it is in no way limited by the disclosure of such a single preferred embodiment, but is capable of numerous modifications within the scope of the appended claims.

We claim:

1. Apparatus for the cross wedge rolling of a workpiece comprising a roll stand with a frame having opposed side members, a pair of opposed working rolls supported between the side members for rotation in the same direction, said working rolls being spaced apart to present a working space between them, working tools mounted on the working rolls, guide bars disposed in the plane of the axis of the workpiece to maintain the workpiece centered in the working space, and segments on the rolls arranged ahead of the working tools to start rotation of the workpiece prior to its engagement by the working tools.

2. Apparatus according to claim 1 wherein the segments for starting the rotation of the workpiece have lateral surfaces bevelled at the workpiece entry side to facilitate the introduction of the workpiece between them.

* * * * *